US005145758A

United States Patent [19]

Kossmehl et al.

[11] Patent Number: 5,145,758

[45] Date of Patent: Sep. 8, 1992

[54] METHOD OF PRODUCING A PRINTING IMAGE CARRIER

[75] Inventors: Gerhard Kossmehl; Matthias Niemitz; Detlef Kabbeck-Kupijai, all of Berlin, Fed. Rep. of Germany

[73] Assignee: Man Roland Druckmaschinen AG, Offenbach-am-Main, Fed. Rep. of Germany

[21] Appl. No.: 380,878

[22] Filed: Jul. 17, 1989

[30] Foreign Application Priority Data

Jul. 29, 1988 [DE] Fed. Rep. of Germany ..... 3825850

[51] Int. Cl.[5] ..... G03G 13/26; C25D 17/00

[52] U.S. Cl. ..... 430/49; 101/463.1; 204/224 R

[58] Field of Search ..... 430/49, 62, 63, 64, 430/65; 204/224 R

[56] References Cited

U.S. PATENT DOCUMENTS 3,638,567 2/1972 Walkup et al. ..... 430/45
4,599,288 7/1986 Fuchizawa ..... 430/49
4,718,340 1/1988 Love et al. ..... 204/222 R
4,729,310 3/1988 Love et al. ..... 204/222 R
4,849,314 7/1989 Blanchel-Fincher ..... 430/49
4,872,962 10/1989 Scheer et al. ..... 204/224 R

*Primary Examiner*—John Goodrow
*Attorney, Agent, or Firm*—Frishauf, Holtz, Goodman & Woodward

[57] ABSTRACT

An offset litho or other surface printing press has a printing image carrier with image areas defined by water repelling and water-wettable properties. In order to make possible a reconfiguration of the image directly in the press the printing image carrier is in the form of an electrically conducting substrate, as for example nickel, M which is coated with a polymer to define such areas. The deposition of the polymer is controlled electrochemically with the plate cylinder acting as one electrode and the opposite electrode being in the form of a roller able to rotate in an electrolyte container. One of the two electrodes is in the form of matrix and is activated in a manner in conformity with a pattern of halftone dots corresponding to the desired image. Dependent on whether the polymer is hydrophobic or hydrophilic, the ink accepting areas or either the coated or non-coated parts of the substrate.

26 Claims, 2 Drawing Sheets

METHOD OF PRODUCING A PRINTING IMAGE CARRIER

Reference to related disclosures:

U.S. Pat. No. 4,872,962, Scheer et al, assigned to a related company of the assignee of the present invention, and of which the present inventors are co-inventors.

U.S. Pat. Nos. 4,718,340 and 4,729,310, Love et al European Published Application 101,266, Love et al, to which the above two Love et al patents, in part, correspond.

FIELD OF THE INVENTION

The invention relates to a method of producing a printing image carrier in which electrochemical or electric signals are produced by a controller and are used for locally changing the state of printing image carrier.

BACKGROUND

Printing image carriers which are conventional at the present time for use in surface printing are normally produced photochemically before mounting on the press so that when the printing image carrier is changed idle press time and labor costs are involved.

At the present time it is possible for electronically stored data to be used for the production of the printing image carrier, such data comprising all the required information.

The European patent publication 101,266, to which U.S. Pat. Nos. 4,718,340 and 4,729,310, Love et al, in part correspond, describes a printing press, in which print information in an electronically encoded form may be used to produce or reconfigure, that is, reprogram the printing image carrier while on the press. This means that changing of the printing image carrier and the accompanying idle time of the press and the labor costs no longer occur.

The press in accordance with the said publication is characterized in that the printing image carrier cylinder has a hydrophilic surface which is washed by means forming part of the press; is then coated with a hydrophobic layer; and is then subjected, for example, to a laser beam. The renewal or reconfiguration of the printing image carrier requires a short interruption of the printing process for washing, coating and laser operation. During such changing or renewal of the printing image on the printing image carrier the previously existing ink layer is washed off and a new hydrophobic layer is produced, which is then locally removed with the laser beam in accordance with the printing image. The laser beam is controlled by encoded print information.

In accordance with the U.S. Pat. No. 4,872,962, assigned to a related company of the assignee of this application, to which German Patent 37 05,439 corresponds, the printing image can be produced or modified on the press without the intermediate step using optical means, by employing an electrical control means responding to electronically stored information. The press need not be stopped to change the printing image carrier. In this method the printing image carrier is completely coated with an electrically conductive polymer. The production of changes in the printing image carrier to result in image and non-image areas is caused by electrochemical action on the polymer layer, which may be in hydrophilic or hydrophobic form.

THE INVENTION

It is an object to further develop the concept of the earlier U.S. Pat. No. 4,872,962, and of which the present inventors are co-inventors.

Briefly, a polymer is deposited or removed electrochemically on an electrically conducting substrate material at determined positions thereof.

In the process of the present invention, only a part of the printing image carrier or the entirety thereof is coated, in accordance with image information, with a polymer. If the substrate is hydrophilic, it is coated with a hydrophobic polymer; if the substrate is hydrophobic, it is coated with a hydrophilic polymer. Alternatively, the substrate is completely coated and the polymer locally removed, in accordance with the printing image and, for reconfiguration, is completely recoated.

Using electrical current or fields applied in a punctiform or point-by-point manner, a polymer is electrochemically produced at desired positions on the substrate from material in a solution, which contains a suitable monomer. The same arrangement may be used to electrochemically remove the polymer again in the absence of the monomer so that the print image is removed or erased and the printing image carrier may have new image produced thereon.

This also makes it possible to electronically remove the polymer at desired points from a printing image carrier which was completely coated with the polymer so as to produce the desired printing image or form.

The substrate material for the printing image is electrically conducting so that it acts as an electrode for the electrochemical deposition and removal of the polymer. If in accordance with one feature of the invention the substrate constitutes the non-image areas, the substrate material has to be suitable hydrophilic in order to repel printing ink when coated with dampening fluid.

A suitable hydrophilic substrate material is nickel or an alloy thereof, which after suitable chemical and/or electrochemical pretreatment will have the desired hydrophilic properties.

A printing image carrier whose surface is a nickel surface is placed in a suitable electrolyte and subjected to an anodic current of preferably between 10 and 500 $mA/cm^2$. A suitable electrolyte is diluted nitric acid. The nickel is thus electrochemically etched and will have a surface structure which is suitable for the adhesion of the polymer.

In accordance with a feature of the invention, the material with which the substrate is covered, is an electrically conductive polymer. As is known, aromatic and heteroaromatic compounds and substituted forms thereof may be electrochemically oxidized and thereby-polymerized. As a result, coatings are produced at the anode, whose properties with respect to adhesion and wettability depend to a large degree on the various parameters such as anode surface, type of monomer, concentrations, electrolyte, temperature, current density, etc.

As monomers which may be converted by oxidizing polymerization into suitable polymers, aromatic and heteroaromatic compounds are particularly preferred, i.e. compounds such as thiophene, pyrrole, furan, indole, carbazole, benzothiophene and their substitution products such as 3-alkyl-, and more especially 3-methyl, 3-alkyloxy-, 3,4-dialkyloxy-, more especially 1-methoxy, 3,4-dimethoxy-, 3-alkylthio, more especially 3-methylthio-, 3,4-bis-(methylthio)-thiophene, -pyrrole, -furan, 2,2'-bithienyl, 2,2',5',2''-terthienyl, di-2-thienyl sulfide, -methane, 1,2-di-2-thienylethyklene, aniline, substituted anilines, p-phenylenediamine, diphenylamine, 4,4'-diaminodiphenylmethane, -ether, sulfide or mixtures of these monomers.

A conducting salt which is inert under the conditions of the electrochemical reaction is used as conducting salt and it may more especially be an ammonium, lithium, or sodium tetrafluoroborate, perchlorate, sulfate, hydrogensulfate; a quaternary ammonium salt such as tetraalkylammonium perchlorate, tetrafluoroborate, hexafluorophosphate, hexafluoroantimonate, hexafluoroarsenate, methanesulfonate, toluenesulfonate, trifluoromethanesulfonate, trifluoroacetate; and also an alkylsulfonate or sulfate such as lauryl sulfate and other anionic surface active agents such as for instance alkyl carboxylate. The salts are dissolved in solvents which are also inert under the conditions of the electrochemical reaction, such as acetonitrile, 1,2-dimethoxyethane, methanesulfonic acid, dichloromethane, 1-methyl-2-pyrrolidone, nitrobenzene, nitroethane, nitromethane, dichloromethane, proprionitile, propylene carbonate, tetrahydrofuran, benzonitrile, propylene carbonate, tetrahydroofuran, benzonitrile and sulfolane, water alone or in combination with a surface active agent, or mixtures of such solvents.

For the production and reconfiguration of the printing image the printing image carrier is associated with an electrolyte solution and electrodes, which are part of the printing press. The electrolyte solution preferably contains the conducting salts which are inert under the conditions of the electrochemical reaction, and have a sufficient solubility in the respective solvent used.

The monomer of the monomer mixture is applied to the suitably prepared substrate material from the electrolyte solution using a current density of preferably 0.1 to 20 mA/cm$^2$. A polymer will be formed at the intended positions.

In order to reconfigure the printing image, the polymer has to be removed from the areas which are to be blanked. This is performed electrochemically by applying an electrolyte without the monomer using an anodic current of reverse polarity of preferably between 10 and 500 mA/cm$^2$. A suitable electrolyte is for instance diluted nitric acid. The same control or drive system as during deposit can be used. In this step the original substrate surface is regenerated and may have a new image applied thereon.

The invention will now be described with reference to the working embodiments thereof to be seen in the diagrammatic views.

DRAWINGS

The drawings are identical to the drawings of U.S. Pat. No. 4,872,962.

DETAILED DESCRIPTION OF THE INVENTION

Figure 1:
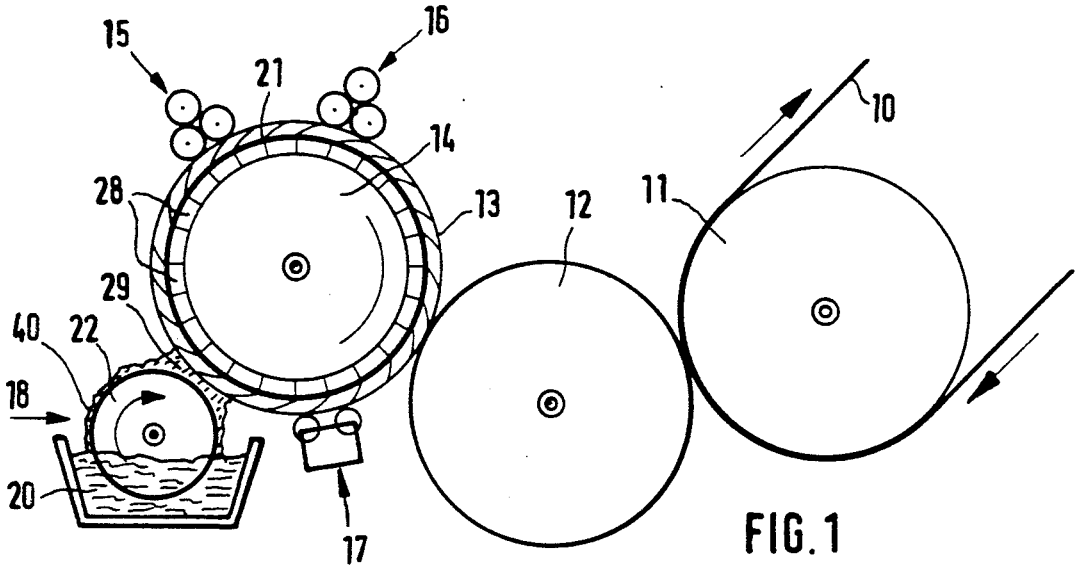
FIG. 1 shows the printing rollers of a press in cross section.

FIG. 1 shows the printing unit cylinders of a printing system which operates on the surface printing or offset litho principle. The paper 10 to be printed is passed between an impression cylinder 11 and a rubber blanket cylinder 12 so as to take up ink from the latter. The ink, distributed in accordance with test or with graphic matter, is transferred from a printing image carrier 13, which is mounted on a rotary plate cylinder 14, to the blanket cylinder 12. The image to be printed is in the form of areas on the printing image carrier 13 or plate which are hydrophobic, that is, water repelling. During the printing action, the printing image carrier 13 is engaged with a dampening unit 15. The hydrophobic areas are not wetted by the dampening fluid on the surface, while the hydrophilic areas take up the fluid. The damped surface then comes into engagement with an inking unit 16 so that ink is applied to the surface. The hydrophilic areas are not inked. On the other hand, the hydrophobic areas forming parts of the image are inked.

The printing image carrier comprises a substrate made of an electrically conductive material, which is either hydrophilic or hydrophobic. The substrate 13 may also be an electrically conductive layer, which forms the surface of a printing plate or, respectively, of a plate or forme cylinder 14.

The press furthermore includes a washing unit 17 and an electrolyte unit 18. After the end of a printing run, the press need not be halted for the washing unit 17 and the electrolytic unit 18 to be put into operation. After moving past the rubber blanket cylinder 12 for inking a blanket thereon, the printing image carrier 13 comes into engagement with the washing unit 17, by which the traces of ink still on the printing image carrier are washed off so that the printing image carrier may ten be acted upon by the electric field of the electrolyte unit 18 so that the polymer is removed which had previously been applied to the substrate 13 in accordance with the image. The reconfiguration of the printing image carrier 13 for the production of new images is carried out in the following manner.

It will further be seen from FIG. 1, the printing image carrier is in contact with the electrolyte solution 20 containing a monomer. It is located between a first electrode 21, which is formed by the printing image carrier cylinder 14, and an opposite or counter electrode 22, which as may be seen from FIG. 1 is in the form of an electrode roller. Counter electrode roller 22 can be displayed with respect to printing plate 13. The electrolyte solution 20 consists of a sufficient quantity of conducting salt, in solution, in a solvent.

The electrolytic process is controlled from an information transfer unit 24, which has an information distributing or allocating system 25, in form of a whole page make-up system, placed in the editorial department, and a control unit 26 located in the printing press. In the editorial department all the information to be printed is electronically stored in a so-called full page imposition or make-up system for the printing of a newspaper or magazine or is electronically encoded using a facsimile transmission system. This information is passed on via an interface to a machine computer, which processes the information into control signals 27, with which, via microprocessors 28, the electrodes 21 and 22 are supplied with voltage or current pulses 23.

In order to produce inkable areas on the printing image carrier 13 as is conventional in the printing process, the image is converted into the form of half-tone dots. In printing newspapers, a half-tone screen of 30/cm is conventional, while for quality work illustrations a screen size of 120/cm is used. Each of the half-tone or image dots has to be able to be produced separately from the others. To do so, the electrode 21 located on the surface of the printing image carrier cylinder 14 is in the form of an electrode matrix, having electrode elements, each being for one half-tone or image.

Figure 3:
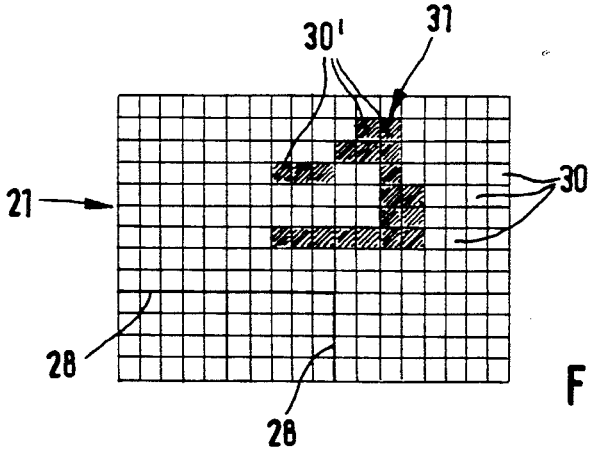
FIG. 3 shows part of the arrangement to be seen in FIG. 1 with the electrode matrix on a larger scale in plan view.
Figure 2:
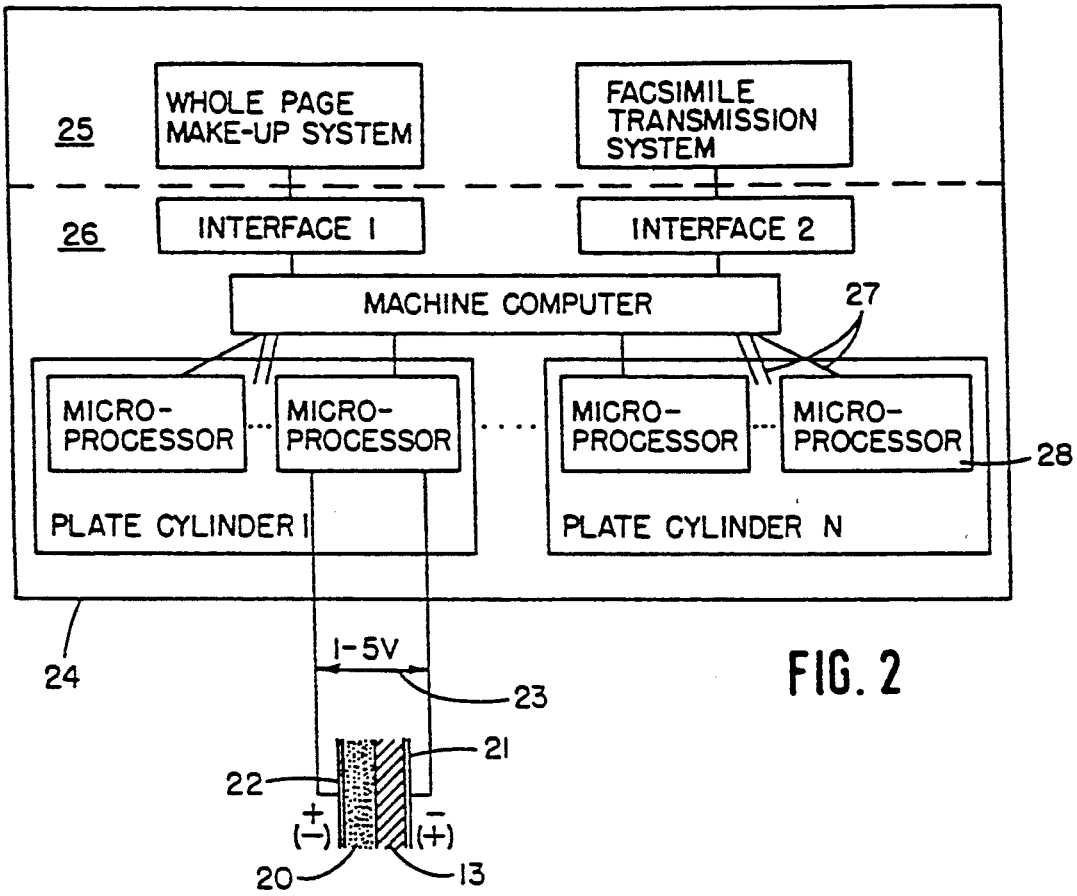
FIG. 2 shows a schematic block diagram for programming or reconfigurating a printing image carrier.

FIG. 3 shows a plan view of the electrode matrix 21 to a considerably enlarged scale. In order to operate the individual electrode elements 30 there is a set of microprocessors 28, each given microprocessor 28 being associated with a given number of electrode elements 30. The microprocessors are arranged in the printing image carrier cylinder 14 on the rear side of the electrode 21, as will be seen on the one hand in cross section in FIG. 1, and on the other hand in FIG. 3 in heavier lines. In this way, one square centimeter of half-tone surface can be driven by one microprocessor.

In order to produce a print pattern 31 on the printing image carrier 13, the electrode elements 30 (FIG. 3) are activated or are not activated in accordance with whether the respective dot is in the condition desired for the new image or not. The electrode elements 30 may be operated in series or one line at a time.

In the arrangement shown in FIG. 1, the electrolyte solution 20 located in a container is passed by the opposite electrode roller 22, which is in the form of a homogeneous electrode with a rough surface. The electrolyte solution may also be introduced into the reconfiguration zone by a separate supply means.

For a reconfiguration operation operation, in which the electrolyte unit 18 is activated, the counter electrode roller 22 is revolved so that its rough surface entrains an electrolyte film 40 and transfers it into the gap 29 between the printing image carrier 13 and the counter electrode 22.

By reversing the polarity of the voltage and using an electrolyte without any monomer, a previously applied polymer is removed so that a new image may be formed.

A further possible modification is one in which the electrode is made with a sieve-like or screen-like surface, through which the electrolyte solution is forced to flow by sufficient pressure into the contact zone 29 during the process of reconfiguring the image so that the ink is kept out of the gap. This makes it possible to eliminate a separate cleaning operation with a separate washing unit 17.

The arrangement and design of homogeneous or of matrix-like electrodes may be in any desired manner. It is thus obviously possible to design the electrode on the printing image carrier cylinder 14 so that it is homogeneous, whereas the counter electrode 22 is in the form of a matrix. If the counter electrode is in the form of a matrix, it may be made in more than one part. In the event of a plurality of counter electrodes being provided, it is possible to reduce the dot density. The matrix electrode can also be made in the form of electrode strips with a single or multiple half-tone dot spacing or only to have a single electrode line, with which the entire printing image carrier is processed line-by-line when the printing image carrier 13 passes through the reconfiguration zone.

Figure 4:
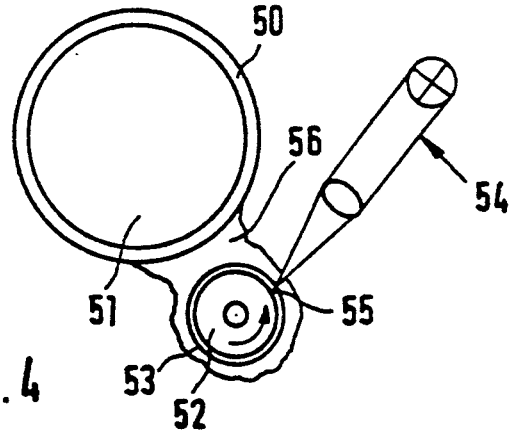
FIG. 4 shows a further working example of the invention.

A further method of producing the matrix electrode involves the use of a homogeneous electrode, for example in the form of a metal roller, which is coated with a photoconductor. FIG. 4 shows a working example in this respect in which the plate cylinder 51 having the printing image carrier 50 thereon is in the form of a homogeneous electrode, and the cylindrical counter electrode 52 assumes the function of the matrix electrode.

The counter electrode has a homogeneous electrode jacket or cover made for instance of metal, which is coated with a photoconductor 53. The photoconductor is exposed to radiation along a line parallel to the axis of cylinder 52 on the circumference of the counter electrode 52 by means of source 54. Source 54 emits radiation in an image producing manner. The photoconductor 53 becomes conducting at the exposed points 55 so that when the conducting point 55 enters the contact zone 56 with the plate cylinder 51, it is possible for the required current to flow between the plate cylinder electrode 51 and the counter electrode 53 for reconfiguring the printing image carrier 50. The image information to be transferred is thus transmitted by the light source 54 and briefly stored on the photoconductor 53.

Preferably the photoconductor has the property of only maintaining the conducting condition caused by the exposure for a short time. The conductivity must be maintained only as far as the contact zone 56. After the line to be transmitted has left the contact zone 56 again, the conducting points 52 have to be rendered non-conducting again in order to make possible the production of a new image part thereon for the new revolution of the counter electrode 53. The photoconductor used may, specifically, be an organic photoconductor.

The desired properties as regards switching the photoconductor 53 into the one or the other condition may be altered by the incorporation therein of substances with luminous persistance prolonging the conducting condition. Furthermore, thermal treatment would be possible so that the exposed points 57 would be rendered more rapidly non-conducting after motion through the contact point 56. The diameter of the drum-like counter electrode 53 and the arrangement of the source 54 of radiation will be designed in accordance with the switching response characteristics of the selected photoconductor.

We claim:

1. A method for producing a printing image carrier for use in a printing press, comprising providing a first electrode in form of an electrically conductive printing image carrier (14, 21, 51);

providing a second electrode in form of a counter electrode (22; 52, 53) and positioning said electrodes with respect to each other to define a gap (29) therebetween;

transporting an electrolyte into said gap, wherein said electrolyte includes an electrically conductive monomer material which has the characteristic that said electrically conductive material can change between monomer and polymer state under the influence of electric potential applied thereto, and said electrically conductive material has the further characteristic that, when in polymer form, it adheres to said carrier (14, 21, 51); and selectively, in accordance with the printing image (31), applying an electrical potential between said electrodes formed by said printing image carrier and the counter electrode to deposit said material from the electrolyte by change, under influence of said electrical potential, on conditions or state of said material in the electrolyte, from a monomer to a polymer, said thus generated polymer adhering to the image carrier (14, 21, 51), selectively, in accordance with the printing image (31).

2. The method of claim 1, wherein said first electrode forming the electrically conductive printing image carrier has a hydrophilic surface (13, 14, 21, 30, 50);

and wherein said material, when in polymer condition or state, is hydrophobic and, in accordance with the printing image, is electrochemically changed to the polymer condition of state and deposited on said carrier.

3. The method of claim 1, wherein said first electrode forming the electrically conductive printing image carrier (30, 50) has a hydrophobic surface;

and wherein said material, when in polymer condition or state, is hydrophilic and, in accordance with the printing image, is electrochemically changed to the polymer condition or state and deposited on said carrier.

4. The method of claim 1, wherein one (13, 14, 21, 30, 50) of said electrodes (13, 14, 21, 30, 50; 22, 52, 53) comprises electrode elements (30);

and wherein said step of selectively applying an electrical potential between said electrodes comprises selectively energizing selected ones of said electrode elements (30) to electrochemically affect said material and change the condition thereof in accordance with energization or non-energization of said selected electrode elements.

5. The method of claim 1, wherein said printing image carrier comprises a printing plate (13) or, optionally, the surface of a printing plate accepting the printing image; and the counter electrode (22) comprises a roller partly dipping into said electrolyte, wherein the electrolyte is in a solution form.

6. The method of claim 1, wherein said electrolyte comprises an electrolyte solution (20) including conducting salts which are inert under the conditions of the electrochemical action to which said material is being subjected.

7. The method of claim 1, wherein said material, when polymerized, is a polymer formed by oxidative polymerization of aromatic or heteroaromatic compounds.

8. The method of claim 1, wherein said first electrode comprises, optionally, the surface of a plate cylinder (14) or a printing plate on a plate cylinder;

said electrolyte comprises an electrolyte solution;

said counter electrode (22) comprises a cylindrical element wetted by and transporting said electrolyte solution into said gap; and wherein said counter electrode is mounted to e displaceable with respect to said plate cylinder or, optionally, said printing plate thereon.

9. The method of claim 1, wherein said step of selectively applying an electrical potential between said electrodes comprises applying potentials in accordance with a half-tone dot image, and controlling said applying step for independently producing the dots, each dot being produced independently of any other dot.

10. The method of claim 4, wherein said electrode elements are arranged in a line;

wherein said step of selectively applying an electrical potential between said electrodes comprises applying electrical potentials to said electrode members to control a line of printing dots; and wherein said electrode members are individually controlled for each printing line.

11. The method of claim 1, wherein the surface of one of said electrodes (12, 14, 21, 30, 50; 22, 52, 53) is in the form of an electrode matrix.

12. The method of claim 1, wherein, to carry out said transportation step, the counter electrode (22; 52, 53) comprises a rotary cylinder which entrains said electrolyte solution and supplies it to the printing image carrier (13, 14, 21, 30; 50).

13. The method of claim 1, wherein the step of transporting said material comprises forcing said electrolyte into said gap.

14. The method of claim 1, further including the step of removing said deposited polymer from said image carrier.

15. The method of claim 14, wherein said step of removing the polymer deposited on the carrier (13, 14, 21, 30; 50) comprises applying an electrical potential across said gap which is of reverse polarity with respect to the potential which generated said polymer to change the material from polymer state to monomer state, said material, in monomer state, separating from said carrier and becoming part of the electrolyte; and transporting an electrolyte to said gap which is devoid of the monomer material for reconstituting said image carrier.

16. The method of claim 1, wherein the counter electrode (22; 52, 53) is coated with a photo conductor (53); and exposing said photo conductor in a point-by-point manner to radiation from a radiation source.

17. The method of claim 1, wherein said step of applying a potential between the printing image carrier and the counter electrode comprises providing a microprocessor (28) located on the back side on one of said electrodes;

and matrix electrode elements (30) are located on said one of said electrodes, said matrix electrode elements being controlled by microprocessor signals from said microprocessor (28) to individually control and drive said matrix electrode elements.

18. The method as claimed in claim 1, wherein the monomer comprises an aromatic or heteroaromatic compound such as a thiophene, pyrrole, furan, indole, carbazole, benzothiophene and their substitution products such as 3-alkyl-, and more especially 3-methyl, 3-alkoxy-, 3,4-dialkyloxy-, more especially 1-methoxy, 3,4-dimethoxy-, 3-alkylthio, more especially 3-methylthio-, 3,4-bis-(methylthio)-thiophene, -pyrrole, -furan, 2,2'-bithienyl, 2,2',5',2''-terthienyl, di-2-thienyl sulfide, -methane, 1,2-di-2-thienylethylene, aniline, substituted anilines, p-phenylenediamine, diphenylamine, 4,4'-diaminodiphenylmethane, -ether, sulfide or mixtures of these monomers, which is dissolved or emulsified in a solvent and is inert under the electrochemical reaction conditions.

19. The method as claimed in claim 1, wherein the the electrolyte solution includes a solvent comprising acetonitrile, 1,2-dimethoxyethane, methanesulfonic acid, dichloromethane, 1-methyl-2-pyrrolidone, nitrobenzene, nitroethane, nitromethane, dichloromethane, propionitile, propylene carbonate, tetrahydrofuran, benzonitrile, propylene carbonate, tetrahydroofuran, benzonitrile and sulfolane, water alone or in combination with a surface active agent, or mixtures of such solvents.

20. The method as claimed in claim 6 wherein the said conducting salt comprises an ammonium, lithium, or sodium tetrafluoroborate, perchlorate, sulfate, hydrogensulfate; a quarternary ammonium salt such as tetraalkylammonium perchlorate, tetratfluoroborate, hexafluorophosphate, hexafluoroantimonate, hexafluoroarsenate, methanesulfonate, toluenesulfonate, trifluoromethanesulfonate, trifluoroacetate; and also an alkylsulfonate or sulfate such as lauryl sulfate and other anionic surface active agents such as for instance alkyl carboxylate, same being inert under the conditions of the electrochemical reaction.

21. A method for removing a polymer which has the characteristic to change between polymer and monomer state under the influence of an electrical potential applied thereto, said polymer being applied and adhering to a printing image carrier for use in a printing press, and wherein said material has the further characteristic that, when in monomer form, it separates from said carrier, comprising providing a first electrode in the form of an electrically conductive printing image carrier (13, 14, 21, 30; 50);

providing a second electrode in form of a counter electrode (22; 52, 53) and positioning said electrodes with respect to each other to define a gap (29) therebetween;

transporting an electrolyte into said gap; and selectively applying an electrical potential across said gap which is of a polarity to change the polymer to monomer state, said monomer becoming part of said electrolyte, and thereby separating from said carrier.

22. The method of claim 21, wherein said first electrode in form of the electrically conductive printing image carrier has a hydrophilic surface, and wherein said polymer material applied to said surface has hydrophobic characteristics;

and wherein said removal step includes changing the condition or state of the material by selectively, in accordance with the printing image, dissolving said polymer in the electrolyte, thereby selectively removing said polymer from the carrier.

23. The method of claim 1, wherein said first electrode in form of the electrically conductive printing image carrier has a hydrophobic surface, and wherein said polymer material applied to said surface has hydrophilic characteristics;

and wherein said removal step includes changing the condition or state of the material by selectively, in accordance with the printing image, dissolving said polymer in the electrolyte, thereby selectively removing said polymer from the carrier.

24. The method of claim 21, wherein one (13, 14, 21, 30, 50) of said first electrodes (13, 14, 21, 30, 50; 22, 52, 53) comprises electrode elements (30);

and wherein said step of selectively applying an electrical potential between said electrodes comprises selectively energizing selected ones of said electrode elements (30) to electrochemically affect said material and change the condition thereof in accordance with energization or non-energization of said selected electrode elements.

25. The method of claim 1, wherein said printing image carrier comprises a printing plate (13) or, optionally, the surface of a printing plate accepting the printing image; and the counter electrode (22) comprises a roller partly dipping into said electrolyte, wherein the electrolyte is in a solution form.

26. The method of claim 21, wherein said electrolyte comprises an electrolyte solution (20) including conducting salts which are inert under the conditions of the electrochemical action to which said material is being subjected.

* * * * *